US005950918A

United States Patent [19]

McDonough

[11] Patent Number: 5,950,918

[45] Date of Patent: Sep. 14, 1999

[54] SHUTTLE MAIL BOX

[76] Inventor: Michael J. McDonough, 5948 Barna Ave., Titusville, Fla. 32780

[21] Appl. No.: 09/002,250

[22] Filed: Dec. 31, 1997

Related U.S. Application Data

[63] Continuation-in-part of application No. 29/062,277, Nov. 12, 1996, abandoned, which is a continuation-in-part of application No. 29/049,882, Feb. 2, 1996, abandoned.

[51] Int. Cl.[6] ..... B65D 91/00

[52] U.S. Cl. ..... 232/17; 232/45

[58] Field of Search ..... 232/17, 45, 38, 232/39; D99/29, 30; 446/71, 72, 73, 74, 75, 76

[56] References Cited

U.S. PATENT DOCUMENTS

| | | | |
|---|---|---|---|
| D. 74,296 | 1/1928 | Cameron . | |
| D. 77,464 | 1/1929 | Cooper . | |
| D. 172,997 | 9/1954 | Stallings . | |
| D. 176,991 | 2/1956 | Moore . | |
| D. 331,481 | 12/1992 | Barlow | D99/30 |
| D. 332,166 | 12/1992 | Williams | D99/29 |
| D. 342,367 | 12/1993 | Lamancusa . | |
| D. 344,392 | 2/1994 | Gardner . | |
| D. 348,969 | 7/1994 | Barbour | D99/30 |
| 4,151,949 | 5/1979 | Huebener | 232/34 |
| 4,403,730 | 9/1983 | Batson | 232/39 |
| 4,524,905 | 6/1985 | Crist | 232/17 X |
| 4,961,717 | 10/1990 | Hickey | 446/76 |
| 5,400,959 | 3/1995 | Cone | 232/34 |
| 5,449,111 | 9/1995 | Sauzedde et al. . | |
| 5,454,509 | 10/1995 | Bellamy et al. | 232/34 |
| 5,458,521 | 10/1995 | Todd | 446/73 |

OTHER PUBLICATIONS

Spaceflight, vol. 23, No. 2, Feb. 1981, Front cover and p. 54.

Spaceflight, vol. 23, No. 4, Apr. 1981, Front cover and pp. 94,95 & 97.

*Primary Examiner*—Brian K. Green
*Assistant Examiner*—William L. Miller
*Attorney, Agent, or Firm*—Law Offices of Brian S. Steinberger; Brian S. Steinberger

[57] ABSTRACT

A space shuttle mail box with nose cone delivery door, tail end delivery door, raisable tail flag and mail box post support. Each of the components structurally resembles a United States Space Shuttle and further includes perpendicular main sidewings, O.M.S. thruster pod protrusions, and dome shaped protrusions extending rearwardly from the tail end delivery door. Both the tail end and the front end nose cone can pivotally open relative to the main cargo bay section in order to put mail into the cargo bay interior.

9 Claims, 11 Drawing Sheets

SHUTTLE MAIL BOX

This invention is a Continuation-In-Part of U.S. Ser. No. 29/062,277 filed on Nov. 12, 1996, which is a Continuation-In-Part of U.S. Ser. No. 29/049,882 filed on Feb. 2, 1996, which are both now abandoned.

This invention relates to mail boxes, and in particular to a mail box assembly resembling a United States Space Shuttle with openable front and back doors having the structural appearance of the front nose and rear engine thruster end of the space shuttle craft and a movable mail flag built into the vertical stabilizer tail of the U.S. space shuttle.

BACKGROUND AND PRIOR ART

Rectangular mail boxes are the most common type of mailbox in the United States. See for example U.S. Pat. No. 5,449,111 to Sauzedde et al.; Des. 172,997 to Stallings; and Des. 176,991 to Moore. Over the years various shapes have been proposed to include various structures such as vehicles, airplanes and even a flying saucer. See for example: U.S. Patents: Des. 74,296 to Cameron; Des. 77,464 to Cooper; Des. 342,367 to Lamancusa; and Des. 344,392 to Gardner. Thus, it can be appreciated that there exists a continuing need for different structural shapes with unique features. For example, none of the prior art has remotely attempted to construct a mail box having the structural equivalence of a United States Space shuttle.

SUMMARY OF THE INVENTION

The first objective of the present invention is to provide a space shuttle mail box that can be assembled from a kit form.

The second object of this invention is to provide a space shuttle mail box having an opening front door that resembles the nose cone section of a U.S. Space Shuttle.

The third object of this invention is to provide a space shuttle mail box having a rear opening end having the structural appearance of the rear engine thruster ends of the U.S. Space Shuttle.

The fourth object of this invention is to provide a space shuttle mail box having a movable mail flag built into the vertical stabilizer tail of the U.S. space shuttle.

A preferred embodiment of the space shuttle craft mail box includes a main body having a curved top surface and vertical sidewalls about a hollow interior, a front door having a cone tip, the front door pivotally connected to a front opening to the interior of the main body, a rear door having a dome shaped protrusion, the rear door pivotally connected to a rear opening to the interior of the main body, and a vertical upright tail connected to the curved top surface, with a flag being raisable and lowerable from the upright tail, wherein the main body, front door, rear door and vertical upright tail are structurally equivalent to a U.S. space shuttle. Dual wings extend outwardly on opposite sides of the main body, each of the dual wings having an interior portion being substantially as long as a longitudinal length of the main body, each of the dual wings having a front edge and a rear edge which expands outwardly from the front edge. The front door further has a rear end substantially covering the front opening to the interior of the main body with a rounded blunt tip, and a rounded brow portion between the rear end and the front end. The rear door further has three dome shaped protrusions connected in a triangular orientation to the rear door. The vertical upright tail further has opposing sidewalls with a hollow interior, an axle pin attached between the opposing sidewalls, and an arm with one end pivotally attached to the axle pin and a second end attached to the flag. An adjustable stand is attached to a base section of the main body, the latter of which has side flanges extending downward adjacent to longitudinal sides of the main body, and a plate attached to the stand, wherein the plate having plate side flanges which mateably attach at various positions to the side flanges of the main body. Off the exterior sides of the main body are protrusions which are structurally equivalent to the onboard maneuvering system(OMS) pods which are side thruster pads on the U.S. space shuttle.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
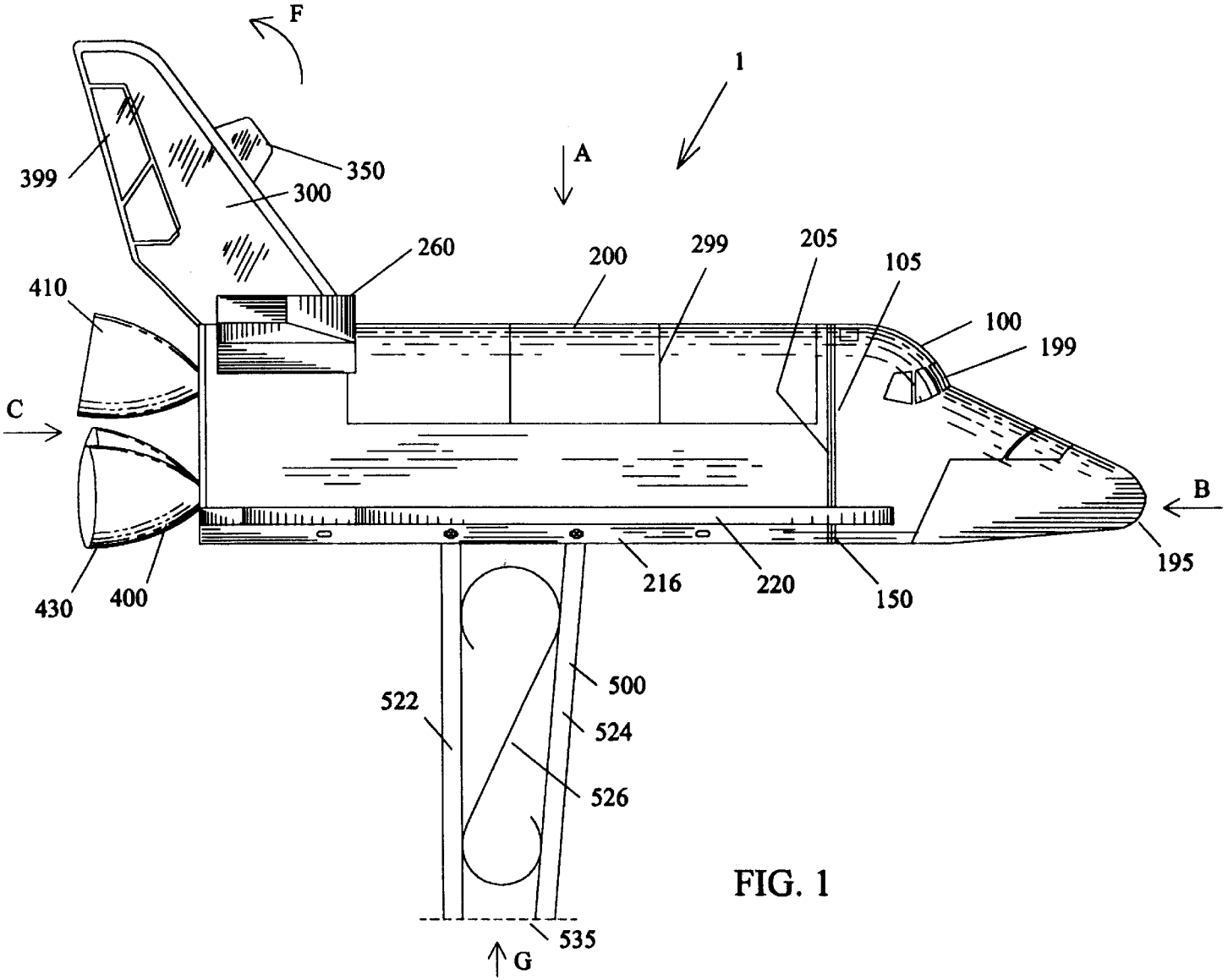
FIG. 1 is a side view of the novel space shuttle mail box and mail box post support with the tail flag indicator in a down position.
Figure 2:
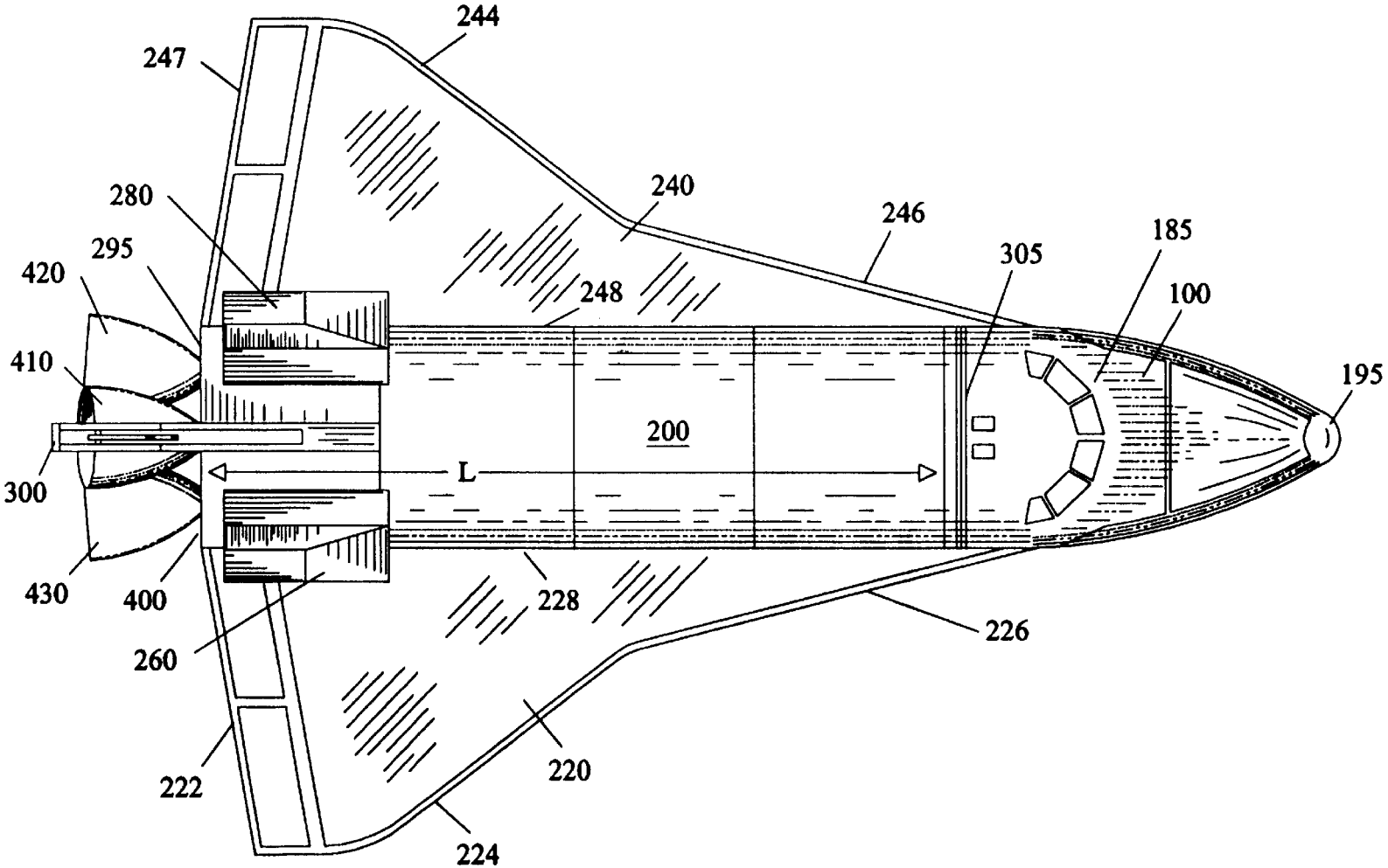
FIG. 2 is a top plan view of the space shuttle mail box of FIG. 1 along arrow A.
Figure 3:
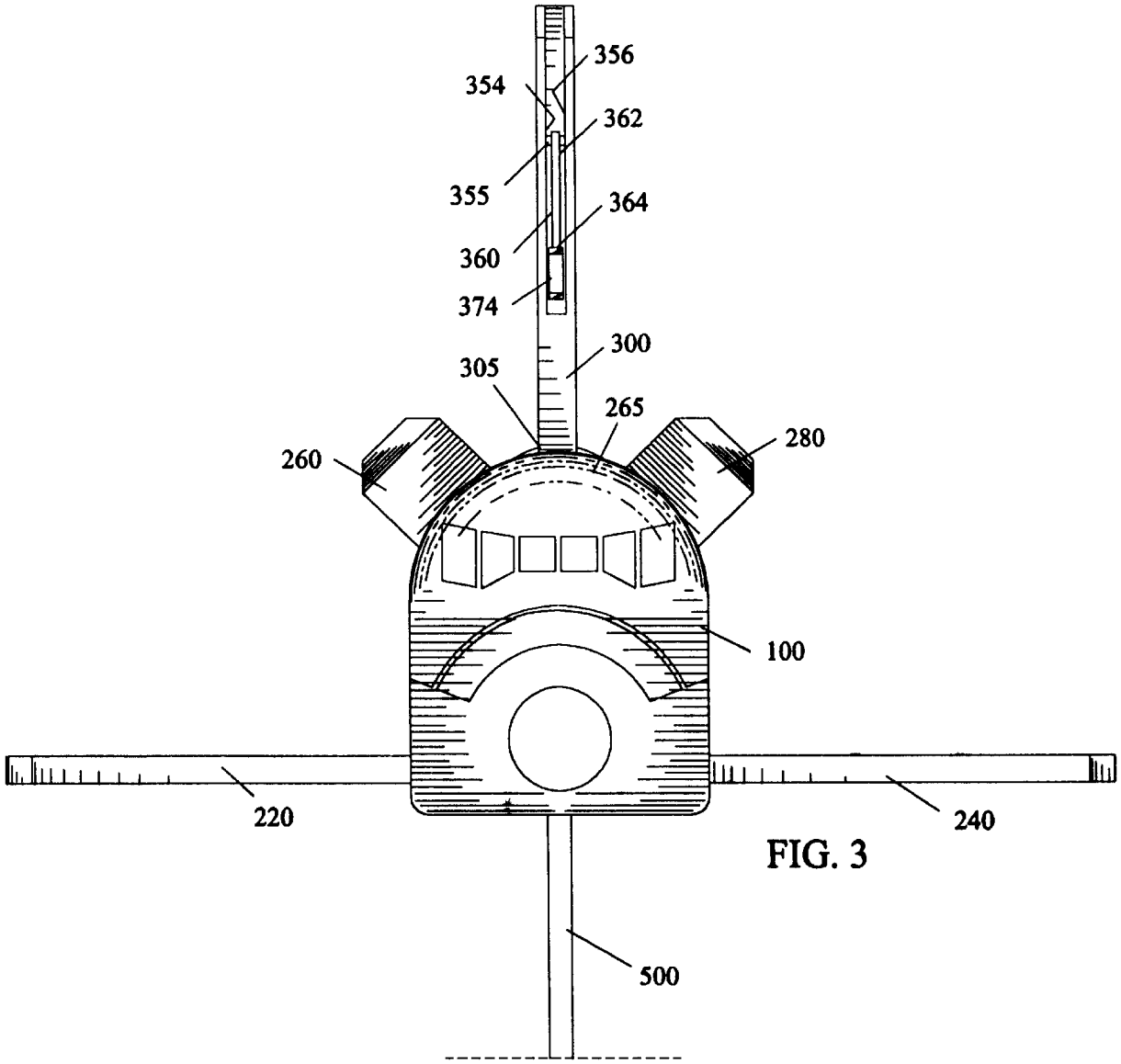
FIG. 3 is a front view of the space shuttle mail box and post support of FIG. 1 along arrow B.
Figure 4:
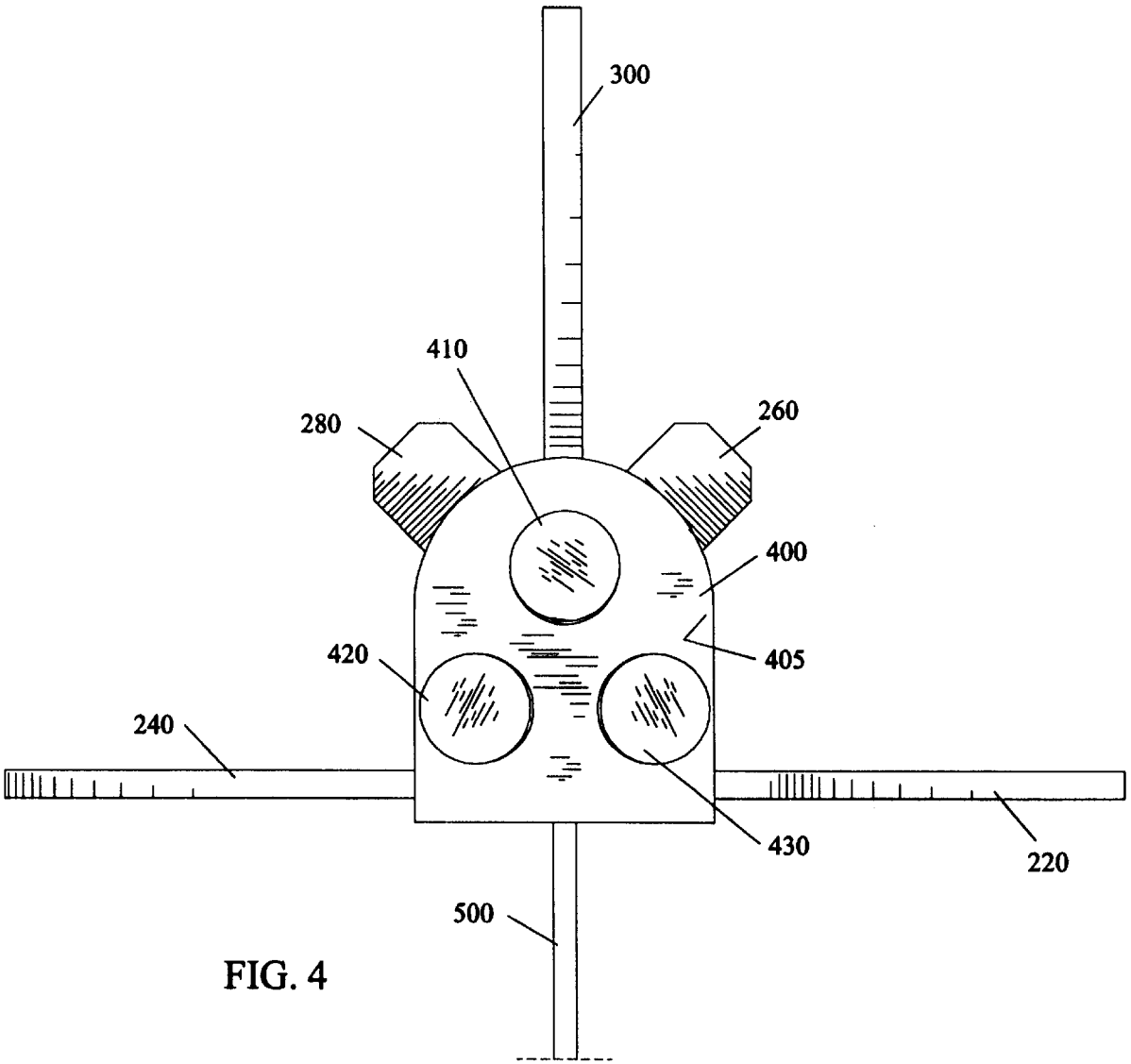
FIG. 4 is a rear view of the space shuttle mail box and post support of FIG. 1 along arrow C.

FIG. 1 is a side view of the novel space shuttle mail box 1 and mail box post support 500 with the tail flag indicator 350 in a down position. FIG. 2 is a top plan view of the space shuttle mail box 1 of FIG. 1 along arrow A. FIG. 3 is a front view of the space shuttle mail box 1 and post support 500 of FIG. 1 along arrow B. FIG. 4 is a rear view of the space shuttle mail box 1 and post support 500 of FIG. 1 along arrow C. Referring to FIGS. 1–4 mail box space shuttle includes a nose cone front end 100, cargo bay mid section 200, flat planar left main wing 220 and flat planar right main wing 240 both perpendicular to and at opposite sides to the cargo bay mid section 200, upper left protrusion 260 and rear upper right protrusion 280 which are structurally equivalent to the onboard maneuvering system(OMS) pods which are side thruster pads on the U.S. space shuttle, both at approximately a forty five degree angles on opposite sides of a rear portion of the a cargo bay mid section 200, vertical stabilizer tail 300 raised above and connected to the rear portion of the cargo bay mid section 200, rear engine thruster end 400 and post support 500 which will all now be described in detail.

Figure 5:
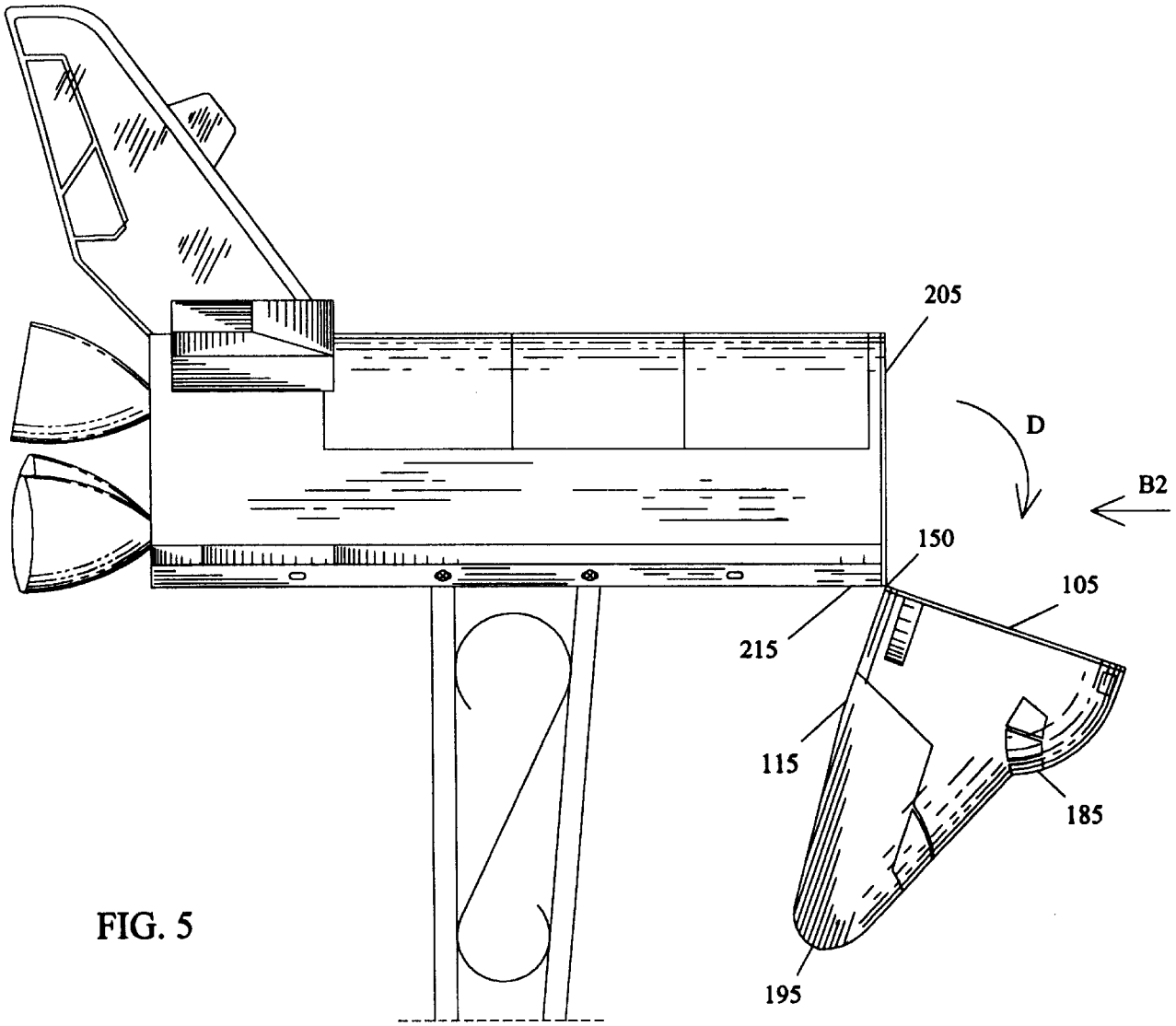
FIG. 5 is another view of the space shuttle mail box and mail box post support of FIG. 1 with the nose cone mail delivery door rotated to an open position along arrow D.
Figure 6:
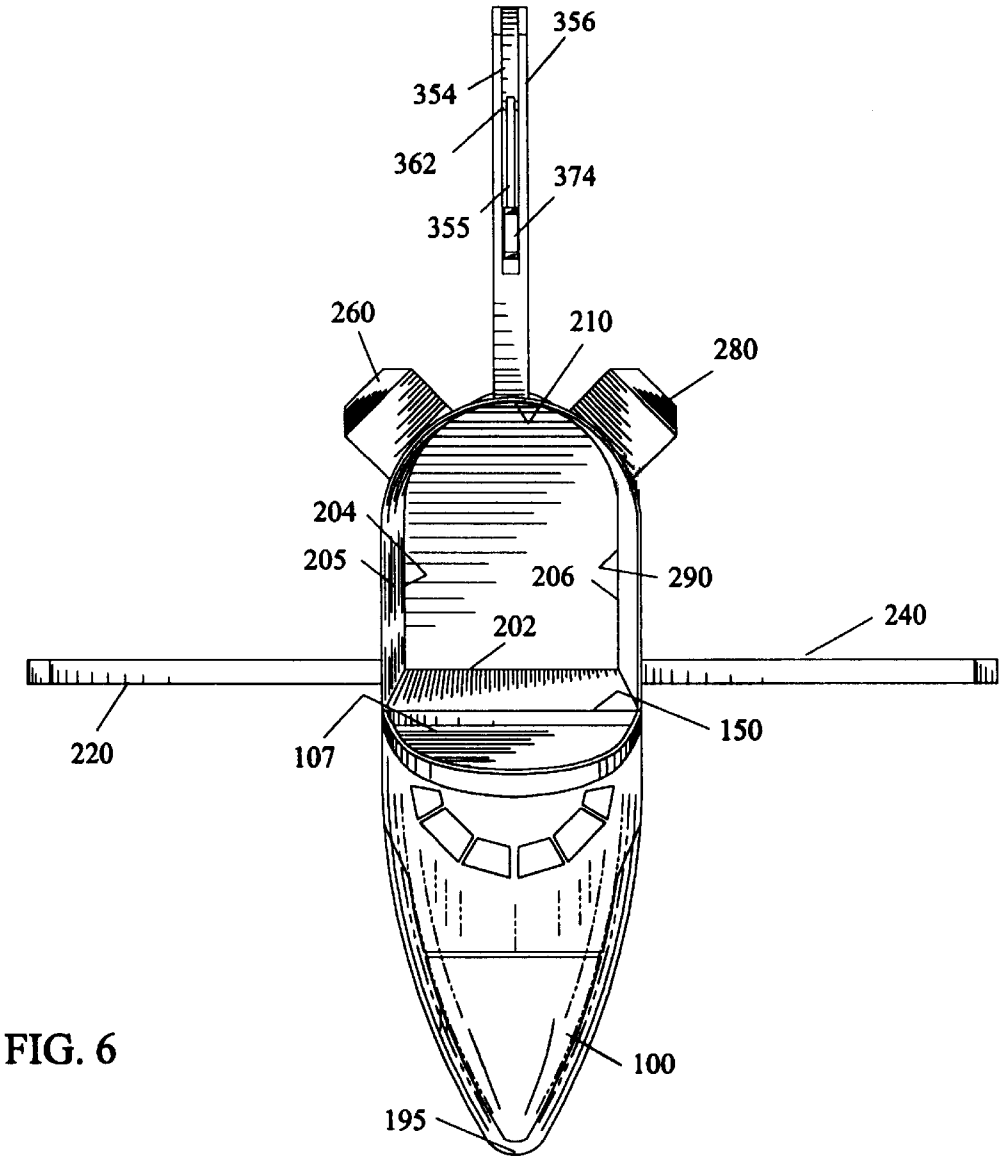
FIG. 6 is a front view of the space shuttle mail box of FIG. 5 along arrow B2 with the nose cone mail delivery door in an open position.

The novel nose cone door 100 will now be described. FIG. 5 is another view of the space shuttle mail box and mail box post support of FIG. 1 with the nose cone mail delivery door 100 rotated to an open position along arrow D. FIG. 6 is a front view of the space shuttle mail box of FIG. 5 along arrow B2 with the nose cone mail delivery door 100 in an open position. Referring to FIGS. 1–3, 5 and 6, nose cone 100 is a front door for accessing the interior of the cargo bay area 290 of the cargo bay mid section 200 of the space shuttle mail box 1. As shown in FIG. 6, the interior 290 of the cargo bay mid section 200 has a flat bottom floor 202, vertical side walls 204 and 206 perpendicular to the bottom floor 202 and a raised convex curved ceiling 210. Referring to FIGS. 1–3, 5 and 6, nose cone 100 has a rear portion 105 with a matching height and width as that of the front end 205 of the cargo bay mid section 200. The front portion of the nose cone 100 curves down to a rounded edge raised pilot window area brow section 185 and and then angles downward at approximately forty five degrees to the horizontal to rounded tip end 195. A longitudinal hinge 150 allows the nose cone 100 to pivot relative to the front bottom end 215 of the cargo bay mid section 200. An optional lip 107 (see FIG. 6), allows the rear portion 105 of the nose cone 100 to fit snugly about the front end opening 205 of the cargo bay mid-section 200 holding the nose cone door 100 in place.

Figure 7:
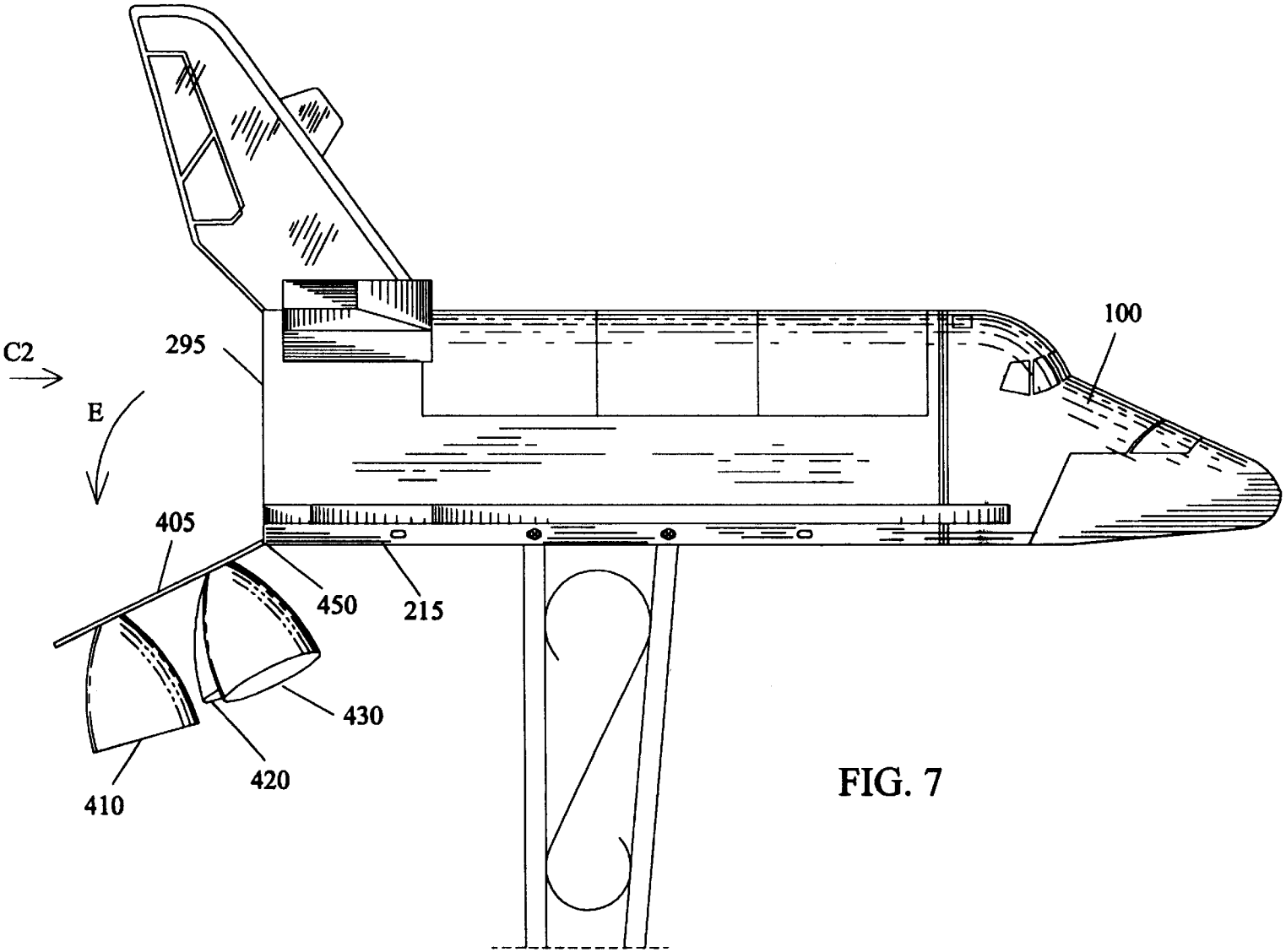
FIG. 7 is another view of the space shuttle mail box and mail box post support of FIG. 1 with the tail end mail delivery door rotated to an open position along arrow E.
Figure 8:
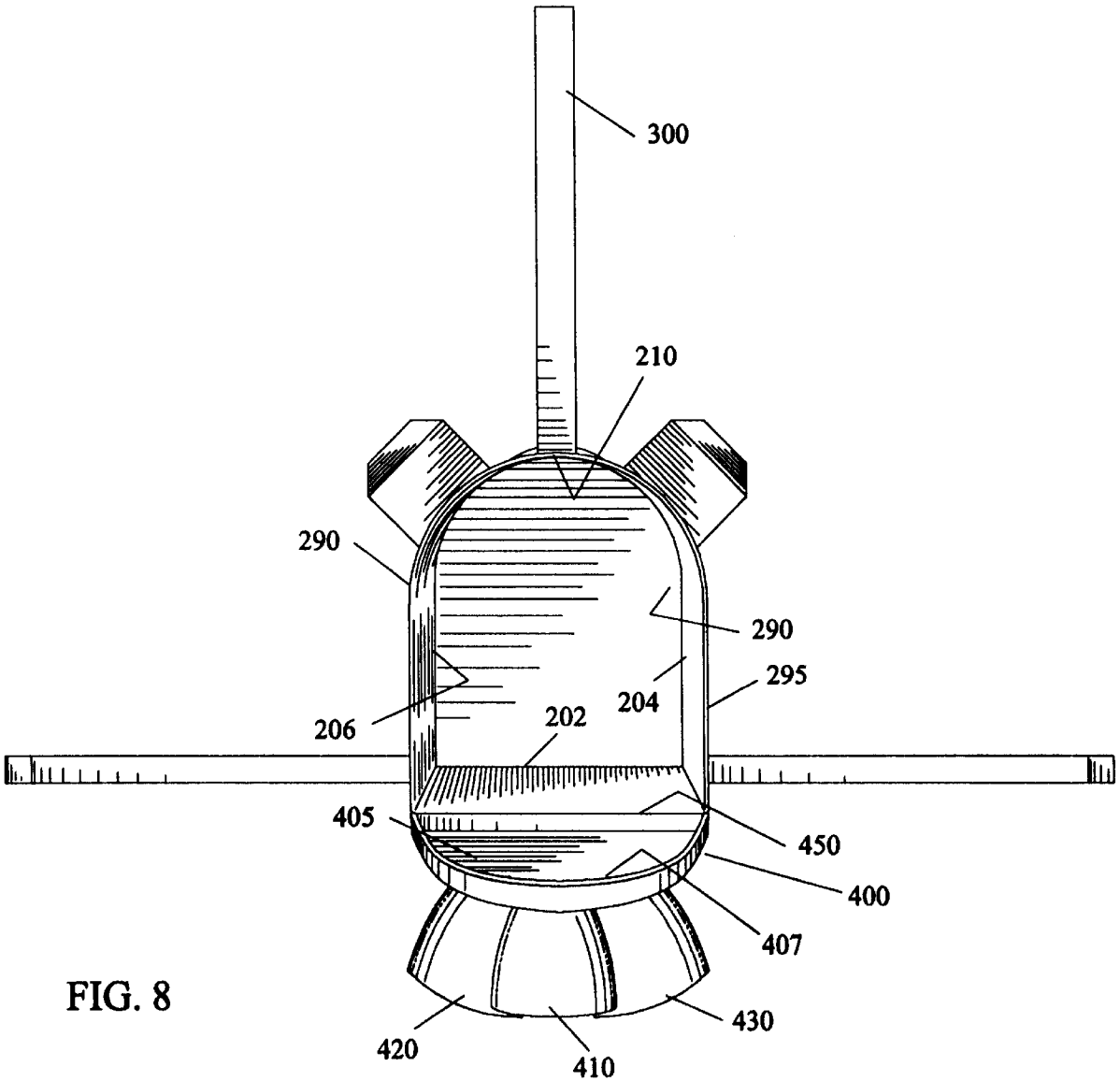
FIG. 8 is a rear view of the space shuttle mail box of FIG. 7 along arrow C2 with the tail end mail delivery door in an open position.
Figure 9:
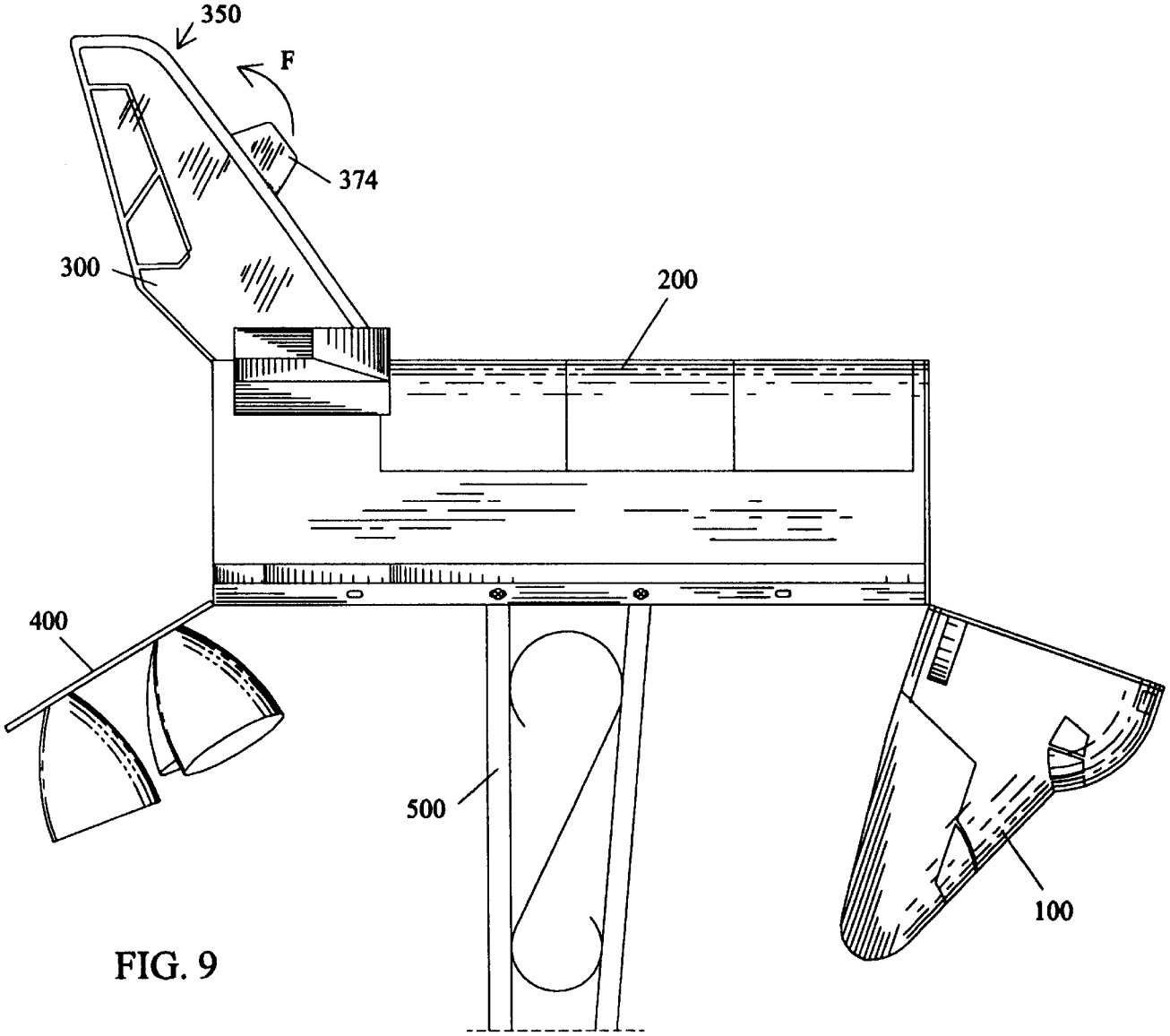
FIG. 9 is another side view of the space shuttle mail box and mail box post support of FIG. 1 with both the nose cone mail delivery door and the tail end delivery door rotated to open positions.

The novel tail end door 400 will now be described. FIG. 7 is another view of the space shuttle mail box 1 and mail box post support 500 of FIG. 1 with the tail end mail delivery door 400 rotated to an open position along arrow E. FIG. 8 is a rear view of the space shuttle mail box 1 of FIG. 7 along arrow C2 with the tail end mail delivery door 400 in an open position. Referring to FIGS. 1–4, 7 and 8, tail end 400 is a rear door for accessing the interior of the cargo bay area 290 of the cargo bay mid section 200 of the space shuttle mail box 1. As shown in FIG. 8, the interior 290 of the cargo bay mid section 200 has a flat bottom floor 202, vertical side walls 204 and 206 perpendicular to the bottom floor 202 and a raised convex curved ceiling 210. Referring to FIGS. 1–4, 7 and 8, tail end 400 has a flat wall 405 with a matching height and width as that of the rear end 295 of the cargo bay mid section 200. Three dome shaped protrusions 410, 420, 430 are arranged in a triangular configuration to resemble the rear engine thrusters of the space shuttle and are connected to the exterior of rear door 400. A longitudinal hinge 450 allows the tail end 400 to pivot relative to the front bottom end 215 of the cargo bay mid section 200. An optional lip 407 (see FIG. 8), allows the tail end door 400 to fit snugly about the rear end opening 295 of the cargo bay mid-section 200 holding the tail end door 400 in place. FIG. 9 is another side view of the space shuttle mail box 1 and mail box post support 500 of FIG. 1 with both the nose cone mail delivery door 100 and the tail end delivery door 400 rotated to open positions.

Figure 10:
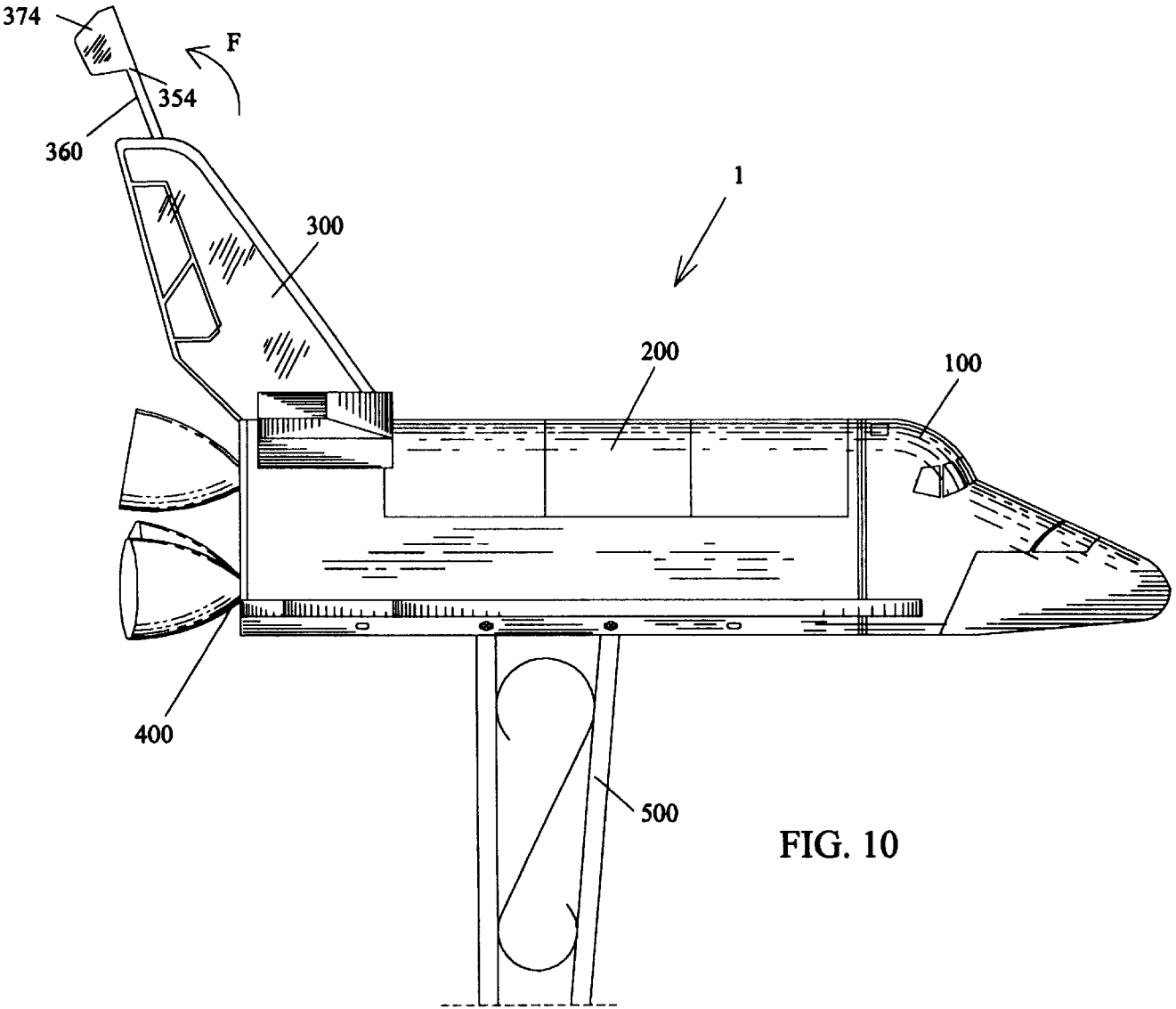
FIG. 10 is another view of the space shuttle mail box and mail box post support of FIG. 1 with the flag indicator rotated to a raised position along arrow F.

The novel flag indicator 350 will now be described. FIG. 10 is another view of the space shuttle mail box 1 and mail box post support 500 of FIG. 1 with the flag indicator 350 rotated to a raised position along arrow F. Referring to FIGS. 1–3, 6, 9 and 10, vertical stabilizer tail 300 is raised above and connected at a bottom end 305 to a curved roof end portion 265 of the cargo bay mid section 200. Tail 300 has a hollow interior 301 with an axle pin 355 attached across the interior side walls 354 and 356 of the hollow interior 301. Flag 350 has a longitudinal arm 360 with a through-hole at one end 362 being pivotally attached to the axle pin 355. The other end 364 of flag 350 is a rectangular shaped flag portion 374 resembling the traditional flag of a mail box. The flag portion 374 functions to indicate that mail is to be picked up when the flag 374 is in the raised position shown in FIG. 10. In the lower orientation position as shown in FIGS. 1–3 and 9, flag portion 374 of flag 350, indicates that mail is not to be picked up.

Figure 11:
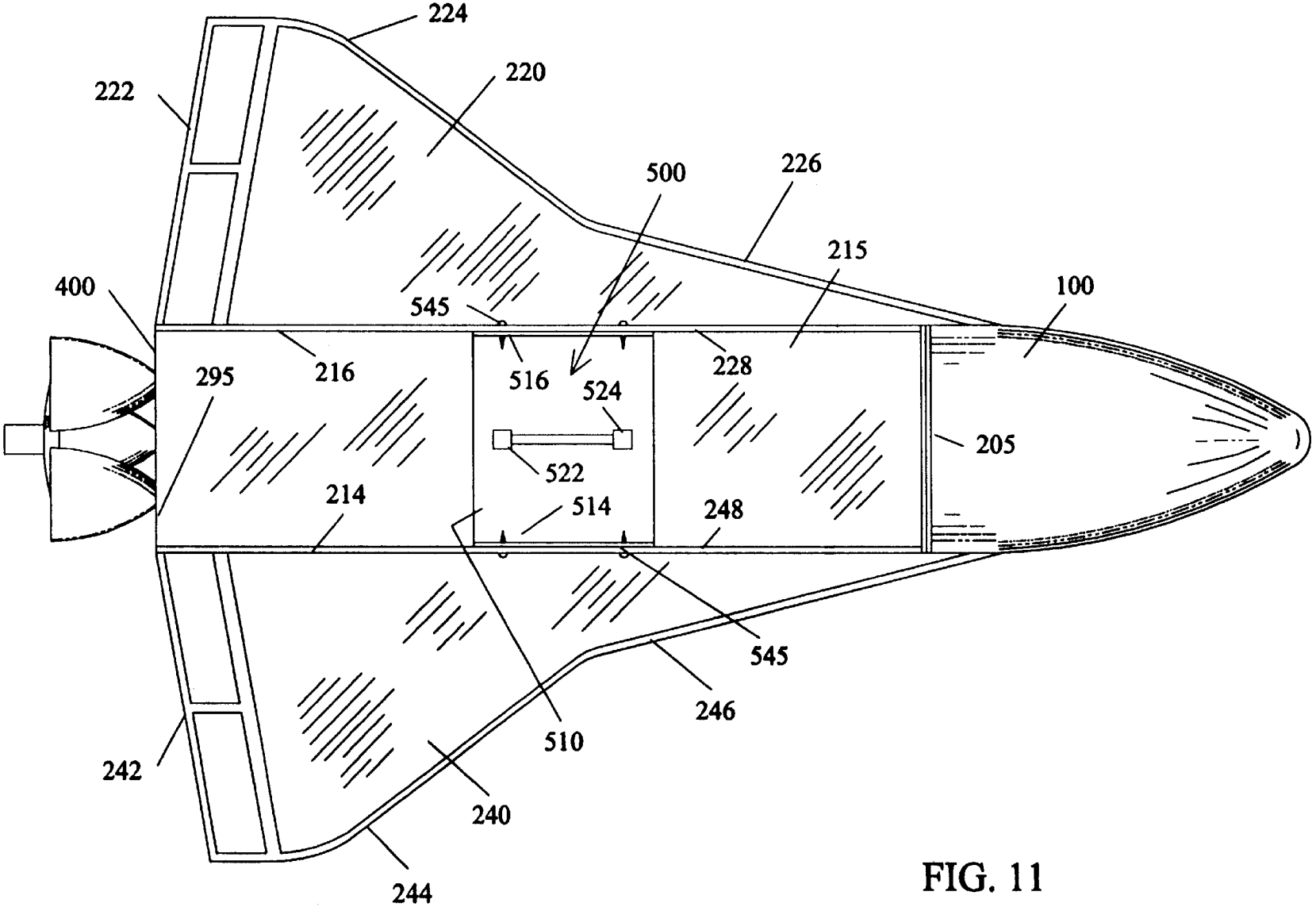
FIG. 11 is a bottom plan view of the space shuttle mail box and mail box post support of FIG. 1 along arrow G.

FIG. 11 is a bottom plan view of the space shuttle mail box 1 and mail box post support 500 of FIG. 1 along arrow G. Referring to FIGS. 1 and 11, bottom end 215 of the cargo bay mid section 200 is generally rectangular with hanging down side flanges 214 and 216. Post support can be two vertical post supports 522, 524 with a bent bar pattern 526 therebetween having one end 535 inserted into the ground and an opposite end connected by soldering or welding or the like, to a flat plate 510. The flat plate 510 has bent side flanges 514, 516 that fit within respective side flanges 214, 216 of the bottom end 215 of the cargo bay mid section 200. Fasteners 545 such as screws and the like attach the respective matching flanges to one another. The location of the post support 500 is adjustable by moving plate 510 relative to any location within side flanges 214, 216 of the bottom end 215 of the cargo bay mid section 200.

Referring further to FIGS. 1 and 11, flat planar left main wing 220 and flat planar right main wing 240 are both perpendicular to and at opposite sides to the cargo bay mid section 200. Each of the main wings 220, 240 includes respective long flat portions 228, 248 that are each substantially the same length or longer than that of the length, L, of the cargo bay mid section 200. Long flat portions 228, 248 can be attached to cargo bay mid section adjacent to and above side flanges 214 and 216, respectively. Each of the wings 220, 240 has respective rear ends 222, 242 that angle at approximately five to ten degrees from the flat rear end 295 portion of the cargo bay mid section 200. Each of the wings 220, 240 can expand outward approximately thirty degrees from the sides 214, 216 of the cargo bay 200 starting from a point adjacent to the front end 205 of the cargo bay mid section 200, and then expand at an angle of approximately forty-five degrees at side portions 224, 244, respectively.

Peel and stick decals can further be used on the mail box 1 to indicate pilot windows 199, cargo bay doors 299 and rear tail sections 399, respectively.

The materials uses can be injection molded plastic, vacuum formed plastic, fiberglass, aluminum, galvanized metal, wood, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A space shuttle mail box comprising:

a main body having a curved top surface and vertical sidewalls about a hollow interior;

a front door having a cone tip, the front door pivotally connected to a front opening to the interior of the main body;

a rear door having a dome shaped protrusion, the rear door pivotally connected to a rear opening to the interior of the main body; and a vertical upright nonrectangular aerodynamic tail directly connected to and extending upward from a midportion of the curved top surface adjacent to the rear door and having opposing parallel nonrectangular sidewalls defining a hollow interior, the tail having an axle pin attached between the opposing sidewalls adjacent to an upper end of the parallel nonrectangular sidewalls;

an arm with one end pivotally attached to the axle pin and a second end;

a flag attached to the second end of the arm, the flag being raisable from a stored upside down position with the arm substantially within the hollow interior defined by the parallel sidewalls to an extended upright position exposed from the upright tail.

2. The space shuttle mail box of claim 1, further comprising:

dual wings on opposite sides of the main body, each of the dual wings having an interior portion being substantially as long as a longitudinal length of the main body, each of the dual wings having a front edge and a rear edge which expands outwardly from the front edge.

3. The space shuttle mail box of claim 1, wherein the front door further includes:

a rear end substantially covering the front opening to the interior of the main body.

4. The space shuttle mail box of claim 1, wherein the front door further includes:

a rounded brow portion between the rear end and the front end.

5. The space shuttle mail box of claim 1, wherein the dome shaped protrusion further includes:

three dome shaped protrusions connected in a triangular orientation to the rear door.

6. The space shuttle mail box of claim 1, further comprising:

a stand being attached to a base section of the main body.

7. The space shuttle mail box of claim 6, wherein the main body further includes:

side flanges extending downward adjacent to longitudinal sides of the main body;

a plate attached to the stand, the plate having plate side flanges which mateably attach at various positions to the side flanges of the main body.

8. The space shuttle mail box of claim 1, further comprising:

rear side protrusions extending off rear upper sides of the main body.

9. A mail box comprising:

a main body having a curved top surface and sidewalls about a hollow interior;

a front door pivotally connected to a front opening to the interior of the main body;

a rear wall closing a rear opening to the interior of the main body, opposite the front door;

a vertical upright nonrectangular aerodynamic tail directly connected to and extending upward from a midportion of the curved top surface adjacent to the rear wall and having opposing parallel nonrectangular sidewalls defining a hollow interior, the tail having an axle pin attached between the opposing nonrectangular sidewalls adjacent to an upper end of the parallel sidewalls;

an arm with one end pivotally attached to the axle pin and a second end; and a flag attached to the second end of the arm, the flag being raisable from a stored upside down position with the arm substantially within the hollow interior defined by the parallel sidewalls to an extended upright position exposed from the upright tail.

* * * * *